US005939870A

United States Patent [19]

Nguyen et al.

[11] Patent Number: 5,939,870

[45] Date of Patent: Aug. 17, 1999

[54] VOLTAGE REGULATOR

[75] Inventors: Don J. Nguyen, Portland; Thovane Solivan, Hillsboro, both of Oreg.

[73] Assignee: Intel Corporation, Santa Clara, Calif.

[21] Appl. No.: 09/154,815

[22] Filed: Sep. 17, 1998

[51] Int. Cl.[6] ..... G05F 1/56

[52] U.S. Cl. ..... 323/282

[58] Field of Search ..... 323/266, 268, 323/270, 273, 279, 282, 288

[56] References Cited

U.S. PATENT DOCUMENTS 5,220,272 6/1993 Nelson ..... 323/282

5,223,753 6/1993 Lee et al. ..... 307/494

5,453,678 9/1995 Bertolini et al. ..... 323/282

5,663,667 9/1997 Blum et al. ..... 327/124

*Primary Examiner*—Matthew Nguyen

*Attorney, Agent, or Firm*—Trop, Pruner, Hu & Miles, P.C.

[57] ABSTRACT

A voltage regulator includes an output stage, an amplifier and a slew rate control circuit. The output stage furnishes an output voltage, and the amplifier interacts with the output stage to regulate the output voltage. The slew rate control circuit interacts with the output stage to establish a first slew rate for the regulator when the regulator is powering up and a different slew rate for the regulator after the regulator has substantially completed powering up.

20 Claims, 2 Drawing Sheets

VOLTAGE REGULATOR

BACKGROUND

The invention relates to a voltage regulator, such as a linear voltage regulator.

A DC-to-DC voltage regulator typically is used to convert a DC input voltage to either a higher or a lower DC output voltage. One type of voltage regulator, called a linear regulator, is often chosen due to its simplistic design. As an example, referring to FIG. 1, a linear regulator 10 may use a transistor 20 to conduct current from an input voltage source 9 (providing a voltage called $V_{IN}$) to a load 23 that is coupled to an output terminal 19 of the regulator 10. To regulate an output voltage (called $V_{OUT}$), the regulator 10 may include an error amplifier 12 that amplifies the difference between a reference voltage (called $V_{REF}$) and a signal (called $V_F$) that is proportional to the $V_{OUT}$ voltage. Due to the negative feedback, an error voltage (called $V_{ERR}$) that is provided by the amplifier 12 functions to control the transistor 20 in a manner to keep the $V_{OUT}$ voltage within prescribed limits. The reference voltage $V_{REF}$ may be provided by, for example, a low power voltage reference circuit 14. Other features of the regulator 20 may include a resistor divider (formed from resistors 16 and 18) that receives the $V_{OUT}$ voltage and provides the $V_F$ voltage.

When the regulator 10 powers up, the voltages and currents of the regulator 10 fluctuate until the voltages and currents reach steady state, or quiescent, bias levels. Unfortunately, these fluctuations may produce power surges that cause the $V_{IN}$ and $V_{OUT}$ voltages to vary outside of specified tolerances. For example, the $V_{IN}$ and $V_{OUT}$ voltages may be supplied by voltage rails of a computer system power supply and may each not be able to vary beyond a predetermined percentage (five percent, for example) of a predetermined voltage level (five volts, for example).

To minimize the effects that the regulator 10 imposes on the input voltage source 9 during powerup, a limitation may be placed on a slew rate of the regulator 10. In particular, the slew rate is the maximum rate at which the regulator 10 can change the $V_{OUT}$ voltage. By limiting the slew rate, voltage and current fluctuations, such as a fluctuation 32 (see FIG. 2) in the $V_{OUT}$ voltage, are dampened when the regulator 10 powers up.

One way to suppress the slew rate of the regulator 10 is to couple a capacitor 22 (see FIG. 1) between the output terminal 19 and ground. In this manner, because the output current of the regulator 10 is limited, an upper limit is placed on a rate at which the regulator 10 may charge and discharge the capacitor. Thus, this upper limit establishes the slew rate of the regulator 10 and may be significantly lower than the slew rate of the regulator 10 without the capacitor 22. Unfortunately, designs that limit the slew rate for purposes of regulating the powerup state of the regulator 10 may cause the regulator 10 to respond poorly to transient load conditions during normal operation of the regulator 10.

Thus, there is a continuing need for a regulator having a slew rate to accommodate the state of the regulator.

SUMMARY

In one embodiment, a method for use with a voltage regulator includes establishing a first slew rate when the regulator is powering up. A different slew rate is established for the regulator after the regulator has substantially completed the powering up.

DETAILED DESCRIPTION

Figure 1:
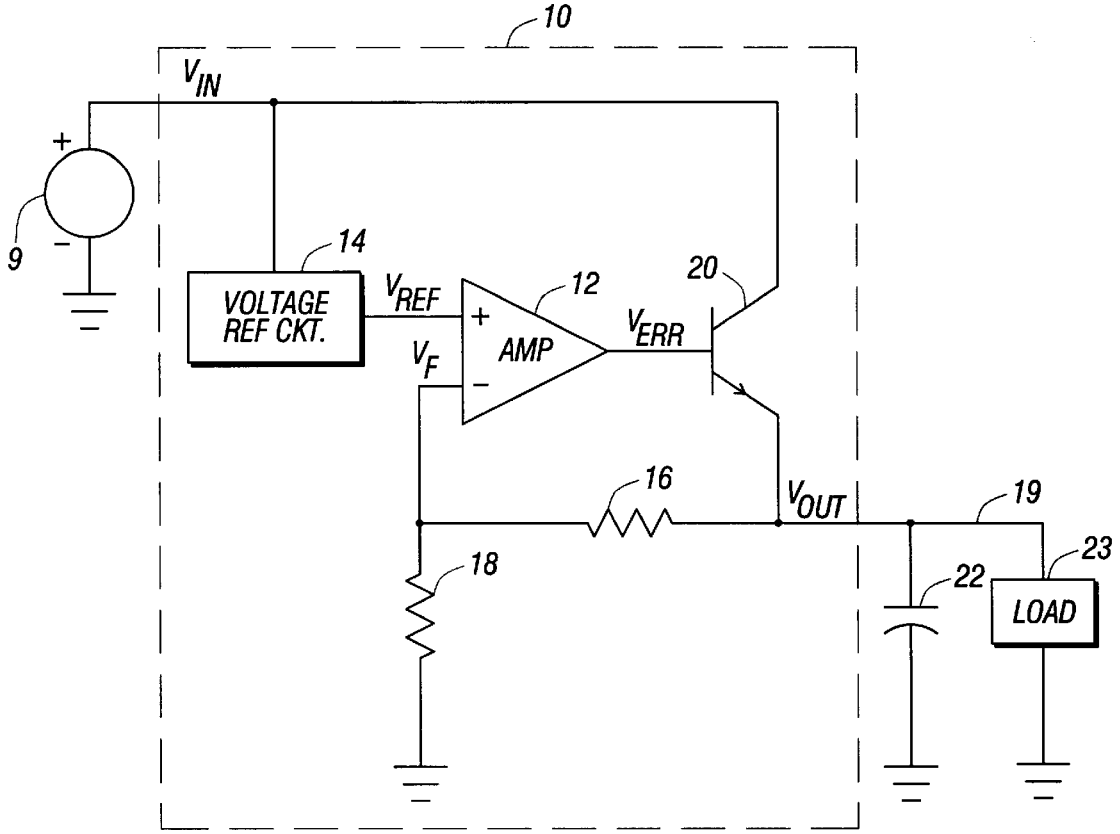
FIG. 1 (PRIOR ART)
FIG. 1 is a schematic diagram of a linear voltage regulator of the prior art.
Figure 2:
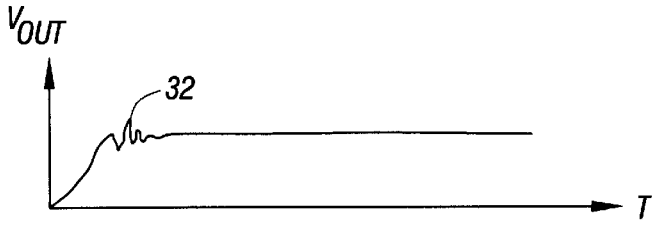
FIG. 2 is an output voltage waveform of the regulator of FIG. 1.
Figure 3:
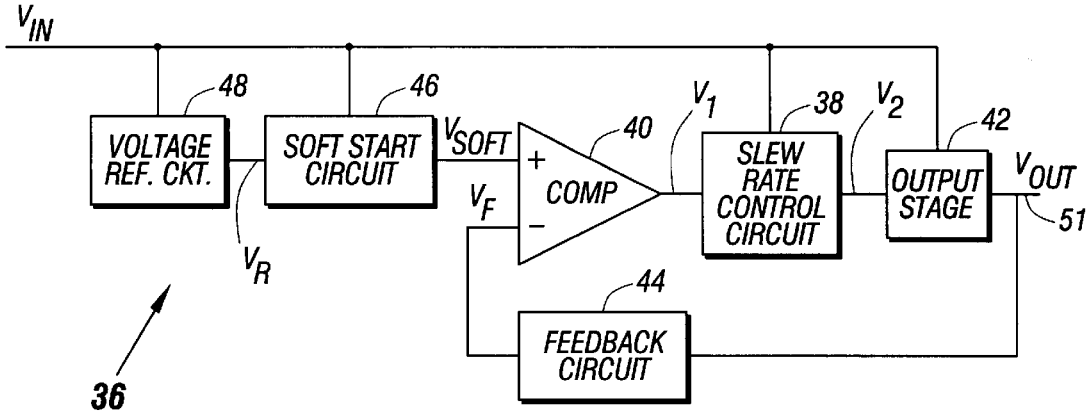
FIG. 3 is a schematic diagram of a voltage regulator according to an embodiment of the invention.

Referring to FIG. 3, an embodiment 36 of a linear voltage regulator in accordance with the invention includes a slew rate control circuit 38 which has two modes: a powerup mode for establishing a relatively low slew rate when the regulator 36 is powering up and a normal mode for establishing a relatively higher slew rate after the regulator 36 has powered up. In this manner, in some embodiments, the slew rate control circuit 38 limits the responsiveness of the regulator 36 during powerup of the regulator 36 and increases the responsiveness of the regulator 36 during normal operation after powerup.

In this context, the term "powerup" generally refers to a transient state of the regulator 36 after the regulator 36 initially receives power. During powerup, the voltages and currents of the regulator 36 have not reached their quiescent values.

The advantages of a regulator that adjusts its slew rate based on a state of the regulator may include one or more of the following: the slew rate may be controlled to minimize turn-on effects due to the powering up of the regulator; both the transient and powerup responses of the regulator may be optimized; the regulator's effect on the input voltage may be minimized; and the regulator may not depend on the drive capability of an output stage to control the slew rate.

In some embodiments, the modes of the slew rate control circuit 38 are controlled by a voltage (called $V_1$) that is provided by a comparator 40 (an open drain comparator, for example) of the regulator 36. As described further below, when the regulator 36 is in the powerup state, the comparator 40 drives the $V_1$ voltage low to place the slew rate control circuit 38 (and the regulator 36, as described below) in the powerup mode. In this manner, when placed in the powerup mode, the slew rate control circuit 38 establishes a relatively low maximum rate at which an output voltage (called $V_{OUT}$) of the regulator 36 may change during powerup. However, as described below, after powerup, the comparator 40 raises the level of the $V_1$ voltage to regulate the level of the $V_{OUT}$ voltage. The higher level of the $V_1$ voltage, in turn, places the slew rate control circuit 38 in the normal mode and allows the $V_{OUT}$ voltage to change at a much faster rate.

To control the slew rate, the slew rate control circuit 38 controls the slew rate of a voltage (called $V_2$) that is provided by the slew rate control circuit 38 and received by an output stage 42. In some embodiments, the output stage 42 may be a voltage follower circuit that furnishes the $V_{OUT}$ output voltage which cannot change at a rate faster than the rate at which the $V_2$ voltage changes. As a result, the slew rate of the $V_2$ voltage establishes the slew rate of the $V_{OUT}$ voltage (and regulator 36).

The comparator 40 generates the $V_1$ voltage in the following manner. The comparator 40 receives a voltage (called $V_F$) at its inverting input terminal that is proportional to the $V_{OUT}$ voltage and also receives a voltage (called $V_{SOFT}$) at its non-inverting input terminal. The $V_{SOFT}$ voltage, after powerup, indicates a reference voltage (called $V_R$) which the comparator 40 uses to regulate the $V_{OUT}$ voltage. However, during powerup, the soft start circuit 46 suppresses the propagation of the $V_R$ voltage through the soft start circuit 46. This suppression causes the $V_{SOFT}$ voltage to be lower than the $V_R$ voltage and causes the comparator 40 to drive the $V_1$ voltage low. As a result, during powerup, the comparator 40 deasserts the $V_1$ voltage to place the slew rate control circuit 38 in the powerup mode.

The time constant set by the soft start circuit 46 establishes a predetermined duration for the powerup to occur. In this manner, eventually, the $V_{SOFT}$ voltage and the $V_R$ voltage are substantially the same, and as a result, the comparator 40 no longer deasserts the $V_1$ voltage but rather, regulates the $V_1$ voltage at an appropriate level to regulate the $V_{OUT}$ voltage. This level of the $V_1$ voltage places the slew rate control circuit 38 in the normal mode that allows faster response of the regulator 36 to transient load conditions. The $V_F$ voltage may be provided by a feedback circuit 44 that receives the $V_{OUT}$ voltage and furnishes the proportional $V_F$ voltage.

Figure 4:
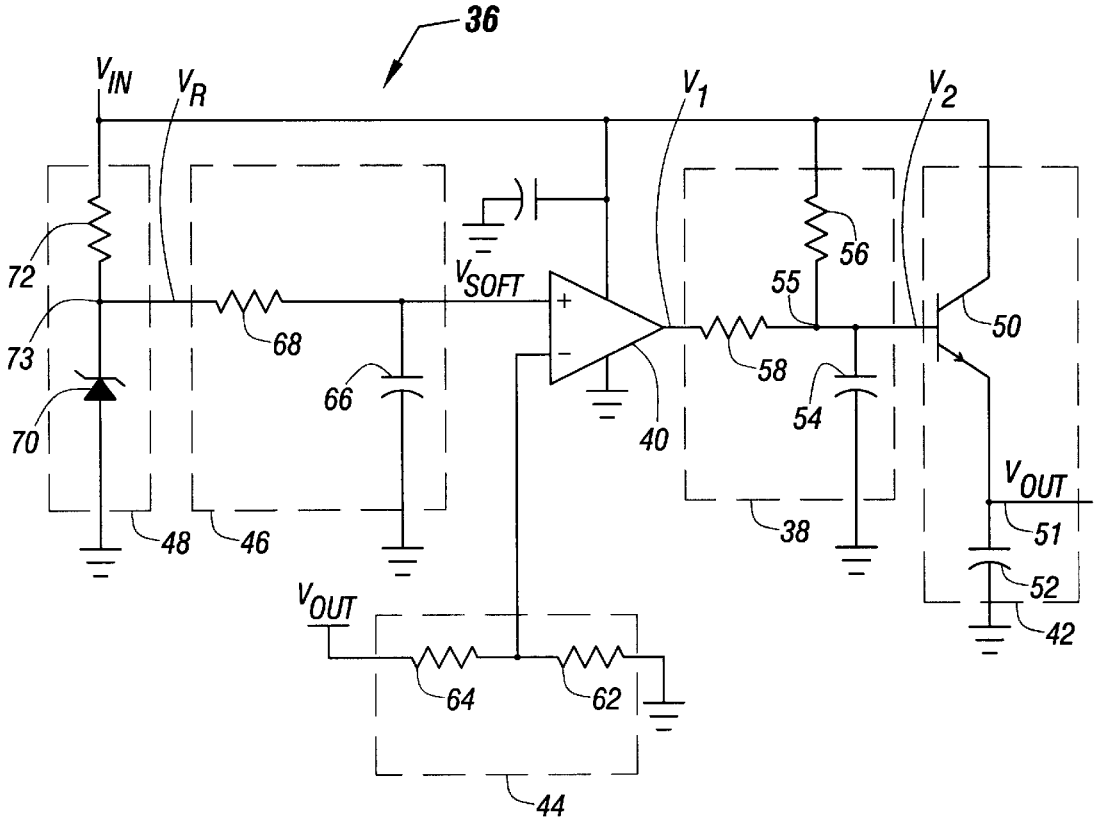
FIG. 4 is a more detailed schematic diagram of the regulator of FIG. 3.

Referring to FIG. 4, to set the maximum rate of change of the $V_2$ signal and thus, set the slew rate, the slew rate control circuit 38 may include a capacitor 54 and two resistors 56 and 58. The capacitor 54 is coupled between a node 55 and ground, and the resistor 56 is coupled between the $V_{IN}$ voltage and the node 55. The resistor 58 is coupled between an output terminal of the comparator 40 and the node 55. Due to this arrangement, the $V_1$ voltage, effectively controls a maximum current available to charge and discharge the capacitor 54 and thus, effectively controls the slew rate of the regulator 36.

The output stage 42 may include an NPN bipolar junction transistor (BJT) 50 that is arranged in an emitter follower configuration. In this manner, the BJT 50 has a collector that is coupled to the $V_{IN}$ voltage and an emitter that is coupled to an output terminal 51 that furnishes the $V_{OUT}$ voltage. A capacitor 52 may be coupled between the terminal 51 and ground. The capacitance of the capacitor 52 may be sufficiently small to not limit the performance of the regulator 36 when transient load conditions occur.

The voltage reference circuit 48 may include a bandgap diode 70 that has its anode coupled to ground and its cathode coupled to a node 73 that furnishes the $V_R$ voltage. A resistor 72 may be coupled between the $V_{IN}$ voltage and the node 73 to set an appropriate bias current in the diode 70 to furnish the desired $V_R$ voltage.

The soft start circuit 46 may include a resistor-capacitor (RC) circuit with a rise time to establish a duration of time to account for powerup of the regulator 36. In this manner, the soft start circuit 46 may include a resistor 68 that is coupled between the node 73 and the non-inverting input terminal of the comparator 40. A capacitor 66 of the circuit 46 is coupled between the non-inverting input terminal of the comparator 40 and ground.

The feedback circuit 44 may be formed from two resistors 62 and 64. In this manner, the resistor 64 may be coupled between the $V_{OUT}$ voltage and the inverting input terminal of the comparator 40, and the resistor 62 may be coupled between the inverting input terminal of the comparator 40 and ground.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A voltage regulator comprising:

an output stage to furnish an output voltage;

an amplifier to interact with the output stage to regulate the output voltage; and a slew rate control circuit to interact with the output stage to establish a first slew rate for the regulator when the regulator is powering up and a different slew rate for the regulator after the regulator has substantially completed powering up.

2. The voltage regulator of claim 1, further comprising:

a powerup circuit to provide a signal to indicate when the voltage regulator is powering up.

3. The voltage regulator of claim 2, wherein the powerup circuit comprises a resistor-capacitor network.

4. The voltage regulator of claim 2, wherein the amplifier compares the signal to the output voltage and indicates the result of the comparison to the slew rate control circuit.

5. The voltage regulator of claim 1, wherein the first slew rate is less than the different slew rate.

6. The voltage regulator of claim 1, wherein the slew rate control circuit comprises:

a capacitor; and a current limiting circuit to establish a maximum current available for charging and discharging the capacitor.

7. The voltage regulator of claim 1, wherein the output stage comprises:

a transistor arranged in an emitter follower configuration.

8. The voltage regulator of claim 1, wherein the amplifier comprises:

an open drain comparator.

9. The voltage regulator of claim 1, further comprising:

a feedback circuit to provide an indication of the output voltage to the amplifier.

10. The voltage regulator of claim 1, further comprising:

a voltage reference circuit to provide an indication of a reference voltage to the amplifier.

11. A method for use with a voltage regulator, comprising:

establishing a first slew rate for the regulator when the regulator is powering up; and establishing a different slew rate for the regulator after the regulator has substantially completed the powering up.

12. The method of claim 11, wherein the act of establishing the first slew rate comprises limiting a current available to charge and discharge a capacitor to a predetermined level, and wherein the act of establishing the different slew rate comprises allowing more current to charge and discharge the capacitor.

13. The method of claim 11, further comprising:

regulating an output voltage of the regulator.

14. The method of claim 13, wherein the act of regulating includes comparing output voltage to a reference voltage.

15. The method of claim 14, further comprising:

suppressing the reference voltage when the regulator is powering up.

16. A computer system comprising:

a processor to receive a supply voltage; and a voltage regulator adapted to provide the supply voltage and establish a first slew rate for the regulator when the regulator is powering up and a different slew rate for the regulator after the regulator has substantially completed powering up.

17. The computer system of claim 16, further comprising:

a power up circuit to provide a signal to indicate when the voltage regulator is powering up.

18. The computer system of claim 16, wherein the first slew rate is less than the different slew rate.

19. The computer system of claim 16, wherein the slew rate comprises a slew rate of the supply voltage.

20. The voltage regulator of claim 1, wherein the slew rate comprises a slew rate of the output voltage.

* * * * *